United States Patent [19]

Bleckmann

[11] Patent Number: 4,697,069

[45] Date of Patent: Sep. 29, 1987

[54] TUBULAR HEATER WITH AN OVERLOAD SAFETY MEANS

[76] Inventor: Ingo Bleckmann, Ignaz-Rieder-Kai 11, A-5020 Salzburg, Austria

[21] Appl. No.: 699,385

[22] Filed: Aug. 22, 1983

[51] Int. Cl.[4] ..... H05B 1/02

[52] U.S. Cl. ..... 219/517; 219/510; 219/544; 219/331

[58] Field of Search ..... 219/517, 510, 511, 512, 219/513, 544, 331

[56] References Cited

U.S. PATENT DOCUMENTS

| | | | |
|---|---|---|---|
| 1,859,765 | 8/1928 | Burleigh | 219/510 |
| 2,669,636 | 2/1954 | Rawles | 219/544 |
| 4,230,935 | 10/1980 | Meixner | 219/544 |
| 4,358,667 | 11/1982 | Johnson et al. | 219/331 |
| 4,390,776 | 6/1983 | Yane et al. | 219/517 |

FOREIGN PATENT DOCUMENTS

| | | | |
|---|---|---|---|
| 2101062 | 7/1972 | Fed. Rep. of Germany . | |
| 2442717 | 3/1976 | Fed. Rep. of Germany . | |
| 2021369 | 11/1979 | United Kingdom | 219/510 |

*Primary Examiner*—E. A. Goldberg
*Assistant Examiner*—Lincoln Donovan
*Attorney, Agent, or Firm*—Fleit, Jacobson, Cohn & Price

[57] ABSTRACT

A tubular heater in which a safety fuse or a PTC-element, a sensor for an electronic circuit or a thermostat is disposed as an overload safety means in the non-heated end region of the tubular heater.

3 Claims, 12 Drawing Figures

TUBULAR HEATER WITH AN OVERLOAD SAFETY MEANS

Figure 1:
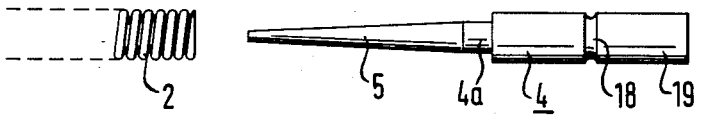

The invention relates to a tubular heater comprising a heating coil of resistance wire, which is disposed in a casing tube, being embedded in insulating material, with an overload safety means.

DE-OS (German laid-open application) No. 21 01 062 discloses an electrical tubular heater with temperature limiting means, wherein the switching member of the temperature limiting means, together with the heating conductor, is embedded in the compacted insulating material of the heater body. In that arrangement, the switching member may be a fusible solder safety device or a bimetal safety device. Arranging the safety device within the heating region was found not to be a practicable proposition as, in the necessary operation of compacting the tubular heater, the safety means is compressed and thereby suffers damage. The rolling forces which are applied in the operation of compacting a tubular heater are so high that for example even solid pins which are embedded into the insulating material are reduced in diameter. Hitherto, no safety device which could withstand such rolling forces has yet been found.

Arranging the safety means within the heated region gives rise to the further disadvantage that the safety means also responds when the tubular heater suffers from calcification, which is generally unavoidable, as the interior of the tubular heater heats up due to the reduction in the amount of energy which is given off. As however tubular heaters must be so designed that they can still be operated when suffering from the calcification which occurs in normal operation, the safety means would have to have a high response threshold. However, having regard to the large production tolerances which are due to mass production, it would then not be possible to ensure that all tubular heaters are adequately protected.

DE-OS (German laid-open application) No. 24 42 717 discloses an electrical heating plate for electric stoves having a means for protection against overheating, wherein a cold conductor which is incorporated into the electrical circuit, that is to say, an element which is referred to as a PTC-element, the cut-out temperature of which is considerably below the upper working temperature of the heating plate, is arranged underneath the plate at a location at which the temperature level in operation of the heating plate is substantially lower than that of the plate. That arrangement makes it possible for the heating plate to reach a higher temperature for a brief period of time, without the cold conductor responding. The problem of brief overheating is not an acute one, in tubular heaters. In contrast, the safety means should respond as quickly as possible if for example the tubular heater begins to go incandescent, for example as a result of the arrangement running dry.

The object of the present invention is to provide a tubular heater with overload safety means, which provides for an improved response characteristic in respect of the overload safety means.

The manner in which that object is achieved is set forth in the characterising features of the main claim. The subsidiary claims set forth preferred embodiments.

In accordance with the invention therefore, the safety means is arranged in the unheated portion within the tubular heater. That arrangement, at the connecting end of the tubular heater, makes it possible for the tubular heater to be compacted and for the safety means to be only subsequently fitted in position. That in principle avoids damage to the safety means, in a simple fashion.

As the unheated portions of the tubular heater do not suffer from calcification and are also colder than the heated portions, the safety means registers only increases in the temperature of the heating conductor, with respect to the relatively cold unheated end of the tubular heater, and irrespective of calcification. That means that the safety means can be given a cut-off value which also takes account of production tolerances and which protects the tubular heater from overloading.

The novel design of the tubular heater gives a number of advantages. As the tubular heater itself has a precisely adjusted safety fuse, a series of uncertainty factors is no longer encountered. In particular, the arrangement ensures that the response value of the overload safety means must necessarily always remain the same, independently of the operating conditions and the operating time of the piece of equipment which is fitted with the tubular heater. Even if additional temperature switches and controllers are used, the arrangement ensures in any case that, in the event of failure of such temperature regulators, the overload safety means responds when a given limit temperature is exceeded.

Figure 7:
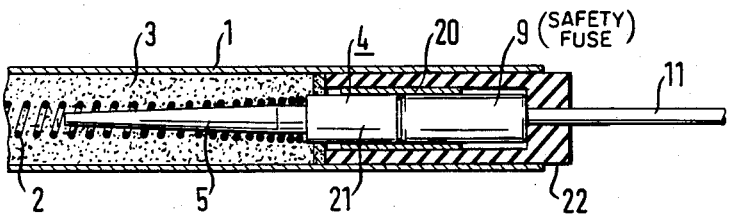
Figure 11:
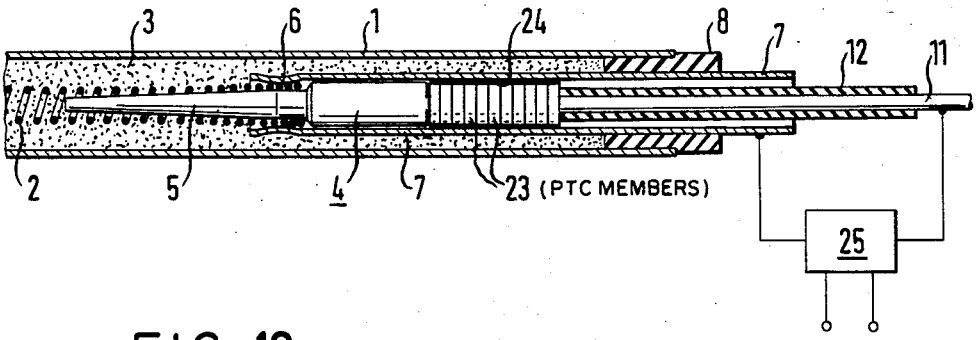
Figure 12:
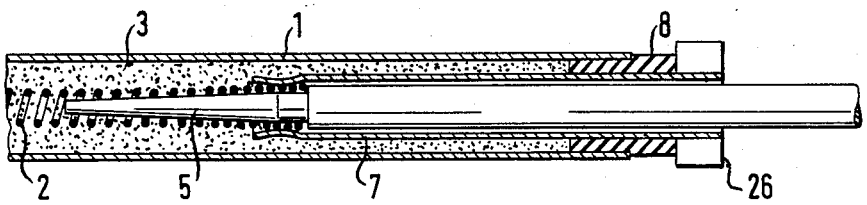
Figure 8:
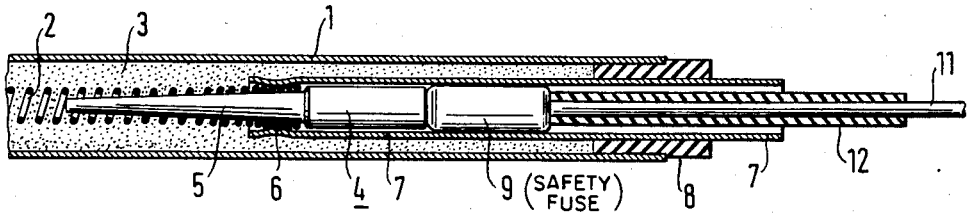
Figure 9:
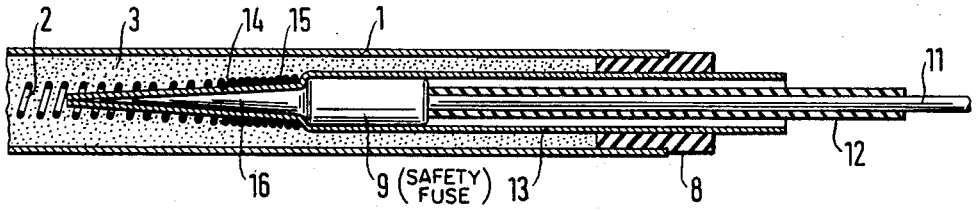
Figure 10:
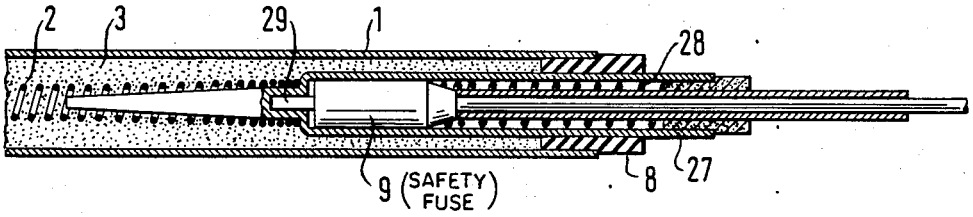

The invention will be further described with reference to the accompanying drawings in which:

FIGS. 1 through 6 show diagrammatic views illustrating the production process, FIG. 7 shows a sectional view of the connecting end of a first embodiment of a tubular heater, produced in accordance with the process, FIG. 8 shows a sectional view, similar to FIG. 7, of a further embodiment, FIG. 9 shows a sectional view, similar to FIG. 8, of a third embodiment, FIG. 10 shows a sectional view, similar to FIG. 1, of a fourth embodiment, FIG. 11 shows a sectional view, similar to FIG. 1, of an embodiment having PTC-discs or plates, and FIG. 12 shows a sectional view, similar to FIG. 1, of an embodiment having a heat sensor.

Figure 2:
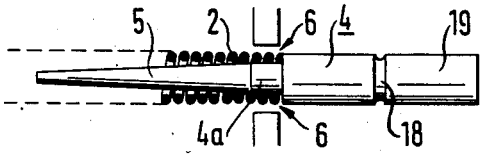
Figure 3:
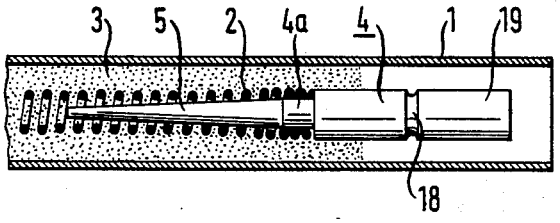

A heating coil 2 is fitted by means of its ends onto a connecting element which comprises a cylindrical body 4, a stepped cylindrical portion 4*a* of smaller diameter and an elongate conical end portion 5. Now, some windings are welded or soldered to the cylindrical portion 4*a*, at 6, as shown in FIG. 2, by means of a contactless soldering or welding process, in particular a laser beam welding process. The resulting assembly is now introduced in the usual manner into a casing tube 1 which is filled with insulating material, for example magnesium oxide. When that is done, the connecting element is partially embedded into the insulating material, that is to say, embedded therein at a maximum as far as an annular groove 18 in the cylindrical body 4.

Figure 4:
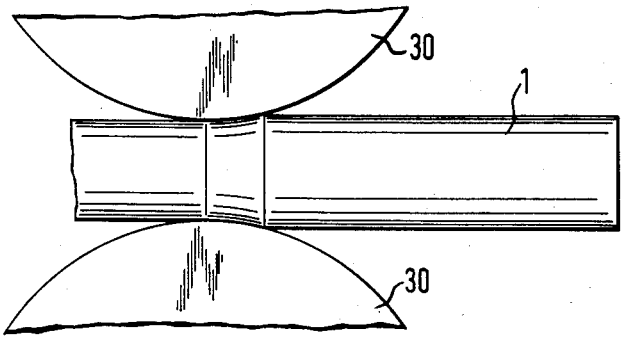
Figure 5:
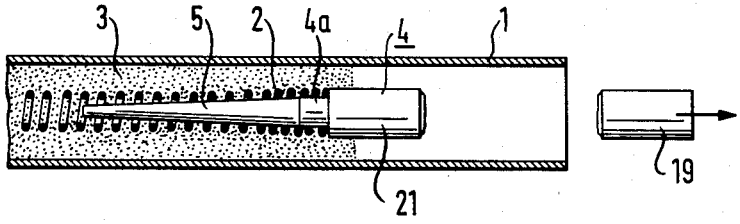
Figure 6:
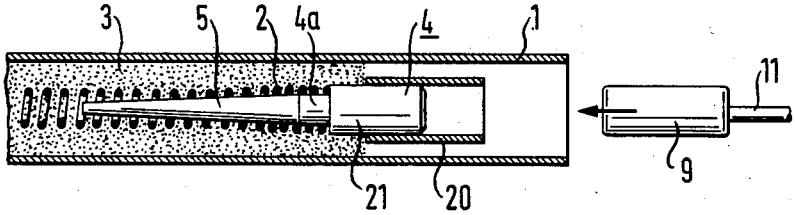

Then, as shown in FIG. 4, the resulting intermediate product is pressed for example by being passed through a pair of rolls 30, for the purposes of compacting the insulating material 3. Thereupon, as shown in FIG. 5, the portion 19 of the connecting element, which projects beyond the annular groove 18, is broken off so that a free space is formed in the end of the tubular heater. By virtue of the annular groove 18, the connecting element is broken off without forming a burr or fin, so that a sleeve 20 can be pushed onto the cylindrical portion 4 of the connecting element. In that connection, the sleeve 20 may be slitted along a generatrix, to enhance its resilient pinching force.

A safety fuse 9 which has a connecting wire 11 is now fitted into the sleeve 20. The safety fuse 9 is fixed and sealed in position by means of an insulating bush member 22.

In the embodiment illustrated in FIG. 8, a connecting tube 7 is fitted over the cylindrical portion of the connecting pin 4 and the weld location 6, and is pressed against the weld location 6. The connecting tube 7 is held concentrically in the casing tube 1 by a sleeve-like insulating bead 8, the end of the connecting tube 7 projecting beyond the end of the insulating bead 8.

A substantially cylindrical safety fuse 9 is now fitted into the connecting tube 7, and is secured to a connecting wire portion 11. An insulating sheath 12 is drawn over the connecting wire portion 11.

The length of the connecting tube 7, which is in the casing tube 1, is embedded into the insulating material. The tubular heater can thus be rolled to compact the insulating material 3 over its full length, the connecting tube 7 being suitably fixed in positin. In that operation, the elongate conical end portion 5 of the connecting pin 4 makes it possible for the pressing rolls to be suitably set by an automatic control means, with the roll gap being increased but the pressing force being maintained at a constant value.

Therefore, the tubular heater has a double connection, the end of the connecting tube 7 which projects beyond the insulating bead 8 having a direct electrical connection to the heating coil 2, while the projecting end of the connecting wire 11 permits electrical connection to heating coil 2 by way of the safety fuse 9.

The tubular heater can therefore be subjected for example in the factory where it is manufactured, for test purposes, to a voltage which goes beyond the capacity of the safety fuse 9. In addition, it is possible to ascertain, by way of the above-mentioned connecting end, whether the heating coil including its weld location 6 on the connecting pin 4 is intact. Furthermore, the end of the connecting tube 7 can be utilised for operating or monitoring conditions which do not require a safety means, for example monitoring or checking the temperature of the heating coil by a resistance measurement operation, performing a running check on the leakage current, and the like.

The safety fuse 9 can be easily replaced by being drawn out of the connecting tube 7.

The embodiment illustrated in FIG. 9 differs from the embodiment illustrated in FIG. 7, in that the connecting pin 4 is omitted. This arrangement has a connecting tube 13, the end 14 thereof, which is disposed in the tubular heater, being of an elongate conical configuration. The heating coil 2 is welded or soldered to the conical end portion 14, at 15. The safety fuse 9 has a correspondingly shaped projection portion 16 which is fitted into the end 14. This embodiment has the advantage that a saving is made in respect of the connecting pin 4 and that the safety fuse 9 is better fixed in position by suitably clamping the end 16. Contact-making is also more reliable.

The use of a contact-less soldering or welding process, for example using laser beams, for securing the heating coil 2 to the connecting pin 4 or the connecting tube 13 is of particular significance, particularly in the embodiment illustrated in FIG. 9. In the case of the previous welding process in which the heating coil had to be pressed against, by means of welding electrodes, in the welding operation, there is the danger that the conically tapering inner end portion 14 of the connecting tube 13 may be pressed in. If, to avoid that danger, the connecting tube 13 were made of greater wall thickness, then, in a tubular heater of the usual sizes, the thickness of the layer of insulating material 3 between the casing tube 1 and the connecting tube 13 would be too small, thereby detrimentally affecting the dielectric strength of the tubular heater.

In the embodiment illustrated in FIG. 10, a tube 27 is fitted to the connecting pins of the tubular heater. Disposed in the tube 27 is a safety fuse 9 which is pressed into position by a spring 28 in such a way as to ensure good electrical contact of the inner connection 29.

The embodiment illustrated in FIG. 11 is similar to that shown in FIG. 8. However, instead of a safety fuse 9, this embodiment uses PTC-discs or plates 23 which are set in place with the interposition of an insulating film or foil 24. The PTC-members 23 comprise a resistance material having a positive temperature gradient. Accordingly, the flow of current from the connecting wire 11 to the connecting pin 4 falls with increasing heating of the PTC-members 23. If therefore, as a result of overheating of the tubular member, heat is correspondingly conducted by the connecting tube 7 from the interior of the tubular heater to the PTC-elements 23, then that gives a corresponding drop in the flow of current due to the increase in resistance, and accordingly causes the heating output to be cut down.

However, under conditions of higher power consumption on the part of the tubular heater, the entire flow of current will not be passed by way of the PTC-elements 23. An auxiliary voltage may be set up between the connecting wire portion 11 and the connecting tube 7, through a suitable relay circuit 25. In that case, in the event of a fall in the flow of current through the PTC-elements 23, as a result of an inadmissible rise in temperature, the main current supply is switched off, through the relay. It will be appreciated that, when using circuit arrangements of that kind, it is also possible for the reverse procedure to be followed, that is to say, instead of the PTC-elements 23, it is also possible to use elements having a negative temperature coefficient, in which case the arrangement is cut out, with increasing current flow.

FIG. 12 shows that it may be advantageous for a corresponding temperature-sensitive assembly or unit 26, to be disposed outside the casing tube 1 of the tubular heater. In that case, the assembly 26 which is shown in diagrammatic form, may comprise the described PTC-elements, but it may also comprise other temperature-sensitive switching members such as bimetal switches or an electrical switching means. Because the temperature-sensitive assembly 26 is disposed outside the casing 1 and is cooled, the response point thereof may be set close to the melting point of the heating coil or of the casing tube 1 of the tubular heater. On the other hand however, the assembly is caused to respond when the current flow rises in an inadmissible fashion, for example when the tubular heater begins to burn through or blow due to the formation of an arc from the heating coil 2 to the casing tube 1.

As the overload safety means is disposed in the non-heated end of the tubular heater and no calcium depositing occurs on the tubular heater casing at that point, that arrangement ensures that, in operation, at a given level of electrical power consumption, the same temperature always obtains in the vicinity of the safety means.

The safety means can therefore be set to a temperature which is for example only 50° C. above that temperature around the safety means. That ensures reliable response long before there is a danger of fire occurring, so that it is also possible to equip, with the tubular heater electrical equipment with burnable plastic casings. The elongate conical end portion 5, 14 of the connecting pin 5 or the connecting tube 13 conducts the heat which occurs in the interior of the tubular heater to the safety element so that the safety element responds if the heating coil 2 attains an excessively high temperature, for example due to the tubular heater burning through or running dry due to a failure in the water supply, for example in washing machines or dishwashing machines. The length of the conical end portion 5, from the weld location 6, which projects into the tubular heater, should correspond to at least twice the outside diameter of the tubular heater.

I claim:

1. A tubular heater comprising: a metallic casing tube; a heating coil of electrical resistance material and disposed in the casing tube, said heating coil being embedded in an electrical insulating material; at least one tubular connecting element adjacent an end of the casing tube and having an innermost end to which an end of the heating coil is electrically conductively connected, said tubular connecting element being at least partially embedded in the insulating material and positioned concentrically to the casing tube; safety equipment means electrically connectable to a source of electrical power and replaceably positioned within the tubular connecting element between the location at which the heating coil is secured to the connecting element and an adjacent outer end of the casing tube for interrupting the flow of current from the source of electrical power to the heating coil when a predetermined temperature is exceeded.

2. A tubular heater comprising: a metallic casing tube; a heating coil of electrical resistance material disposed within the casing tube and spaced inwardly of an inner wall of said casing tube; electrical insulation material carried within said casing tube, said heating coil being embedded in said electrical insulation material; at least one tubular element positioned radially inwardly of and adjacent an end of the casing tube and having its axis concentric to the axis of the casing tube, said tubular element having a length substantially less than that of said casing tube to permit bending of said casing tube between the ends thereof; connection means carried within said tubular element and electrically connected with said heating coil; safety element means electrically connectable to a source of electrical power and replaceably positioned within said tubular element and spaced axially outwardly of said heating coil, said safety element means being electrically connected with said connection means for interrupting the flow of current to the heating coil when a predetermined temperature is exceeded, wherein said connection means includes two electrical connections extending out of an end of said casing tube, one of said connections directly electrically connected to said heating coil and the other of said connections electrically connected to said safety element means, and wherein the two connections are arranged concentrically relative to each other.

3. A tubular heater comprising: a metallic casing tube; a heating coil of electrical resistance material disposed within the casing tube and spaced inwardly of an inner wall of said casing tube; electrical insulation material carried within said casing tube, said heating coil being embedded in said electrical insulation material; at least one tubular element positioned radially inwardly of and adjacent an end of the casing tube and having its axis concentric to the axis of the casing tube, said tubular element having a length substantially less than that of said casing tube to permit bending of said casing tube between the ends thereof; connection means carried within said tubular element and electrically connected with said heating coil; safety element means electrically connectable to a source of electrical power and replaceably positioned within said tubular element and spaced axially outwardly of said heating coil, said safety element means being electrically connected with said connection means for interrupting the flow of current to the heating coil when a predetermined temperature is exceeded, wherein said connection means includes a connecting pin portion positioned within said tubular element, said connecting pin portion including an elongate conical end portion extending outwardly from and beyond the innermost end of said tubular element, and wherein an end of said heating coil is in electrical contact with said conical end portion.

* * * * *